US005450177A

United States Patent [19]

Oyama

[11] Patent Number: 5,450,177

[45] Date of Patent: Sep. 12, 1995

[54] IMAGE FORMING APPARATUS HAVING A TONER CONCENTRATION CONTROL CAPABILITY WITH A TONER CONCENTRATION SENSOR DISPOSED IN A DEVELOPING UNIT

[75] Inventor: Hajime Oyama, Ichikawa, Japan

[73] Assignee: Ricoh Company, Ltd., Tokyo, Japan

[21] Appl. No.: 235,650

[22] Filed: Apr. 29, 1994

[30] Foreign Application Priority Data

Apr. 30, 1993 [JP] Japan ..... 5-128148

[51] Int. Cl.[6] ..... G03G 21/00

[52] U.S. Cl. ..... 355/246; 118/689; 355/208

[58] Field of Search ..... 355/208, 246, 251, 253; 118/688-691, 656-658

[56] References Cited

U.S. PATENT DOCUMENTS 4,032,227 6/1977 Hubbard et al. ..... 355/246 X
4,758,861 7/1988 Nakamaru et al. ..... 118/691 X
5,005,517 4/1991 Fukui et al. ..... 118/689
5,065,190 11/1991 Nakagama et al. ..... 355/246
5,216,470 6/1993 Asanuma et al. ..... 355/246
5,331,377 7/1994 Matsuura et al. ..... 355/208
5,353,102 10/1994 Sato et al. ..... 355/246

*Primary Examiner*—William J. Royer
*Attorney, Agent, or Firm*—Oblon, Spivak, McClelland, Maier & Neustadt

[57] ABSTRACT

In an image forming apparatus, a toner concentration sensor senses the concentration of a toner contained in a developer which is stored in a developing unit. A toner concentration controller controls a toner replenishing member in response to the output of the toner concentration sensor, thereby replenishing the toner from a toner container to the developing unit. Despite that a single toner concentration sensor is located in a position relatively close to a replenishing position, the apparatus insures stable image quality by effecting toner concentration control in harmony with the balance of toner in the entire developing unit.

16 Claims, 5 Drawing Sheets

Fig. 7
Fig. 7A
REPLENISH CLUTCH
Fig. 7B
DEVELOPMENT OF REF PATTERN
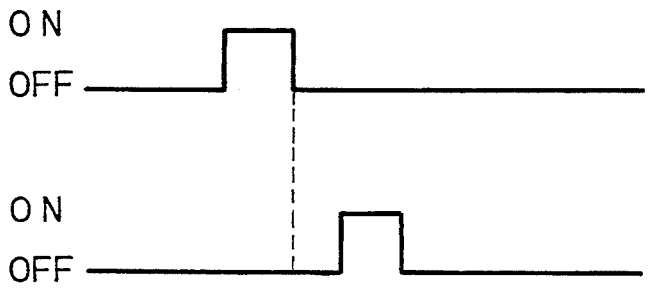
Fig. 8A
REPLENISH CLUTCH
Fig. 8B
DEVELOPMENT OF REF PATTERN
Fig. 8C
CONCENTRATION SENSING FOR CORRECTION
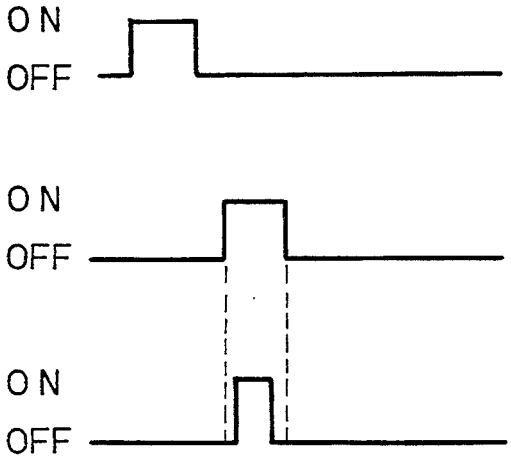

IMAGE FORMING APPARATUS HAVING A TONER CONCENTRATION CONTROL CAPABILITY WITH A TONER CONCENTRATION SENSOR DISPOSED IN A DEVELOPING UNIT

BACKGROUND OF THE INVENTION

The present invention relates to a copier, facsimile apparatus, printer or similar image forming apparatus and, more particularly, to an image forming apparatus having toner concentration control means capable of controlling toner replenishing means which replenishes toner from a toner container to a developing unit in response to the output of toner concentration sensing means which is responsive to the toner concentration of a developer stored in the developing unit.

An apparatus of the kind described has a developing unit in which a developing sleeve, or developer carrier, is disposed. A developer deposited on the developing sleeve has the toner concentration thereof sequentially reduced due to consumption. There has been proposed an image forming apparatus having two toner concentration sensing means, one responsive to the toner concentration of the developer before development and the other responsive to the toner concentration after development. This type of apparatus replenishes toner when the toner concentration after development is lower than a lower limit or stops replenishing it when the toner concentration before development is higher than an upper limit, thereby maintaining the toner concentration of the developer constant. Such an apparatus is taught in, for example, Japanese Patent Laid-Open Publication No. 64-99073.

However, to enhance accurate detection of the consumption and replenishment of the toner, i.e., to maintain the toner concentration of the developer in the developing unit constant with accuracy, the problem with the apparatus described above is that two toner concentration sensing means are necessary and have to be accommodated in the limited space available in the developing unit. This obstructs space, and cost saving and free layout. Moreover, with the conventional apparatus, it is impossible to execute toner concentration control in harmony with the balance of toner while maintaining developing ability constant.

SUMMARY OF THE INVENTION

It is, therefore, an object of the present invention to provide an image forming apparatus which, with a single toner concentration sensing means located at a position relatively close to a toner replenishing position, insures stable image quality by keeping toner concentration control in harmony with the balance of toner in the entire developing unit.

It is another object of the present invention to provide an image forming apparatus which, with a single toner concentration sensing means located at a position relatively close to a toner replenishing position, executes toner concentration control in harmony with the balance of toner in the entire developing unit while maintaining a constant developing ability, thereby insuring stable image quality.

In accordance with the present invention, an image forming apparatus comprises a developing unit for developing a latent image formed on an image carrier by a developer consisting of toner and a carrier, a sensor for sensing the toner concentration of the developer stored in the developing unit, a replenishing member for replenishing the developing unit with toner, an agitating device having a rotatable member for agitating and mixing with the developer the toner replenished to the developing unit, a concentration controller for controlling the replenishing member on the basis of the output of the sensor, and a controller for controlling the sensor such that it senses the toner concentration of the developer present in the developing unit after a replenishing operation of the replenishing member has ended and after the rotatable member has completed one rotation.

Also, in accordance with the present invention, an image forming apparatus comprises a developing unit for developing a latent image formed on an image carrier by a developer consisting of toner and a carrier, a sensor for sensing the toner concentration of the developer stored in the developing unit, a replenishing member for replenishing the developing unit with toner, an agitating member for agitating and mixing with the developer the toner replenished to the developing unit, a concentration controller for controlling the replenishing member on the basis of the output of the sensor, and a controller for controlling the sensor such that it senses the toner concentration of the developer present in the developing unit when an operation for developing the latent image on the image carrier substantially ends.

Further, in accordance with the present invention, an image forming apparatus comprises a developing unit for developing a latent image formed on an image carrier by a developer consisting of toner and a carrier, a sensor for sensing a toner concentration of the developer stored in the developing unit, a replenishing member for replenishing the developing unit with toner, an agitating member for agitating and mixing with the developer the toner replenished to the developing unit, and a concentration controller for controlling the replenishing member on the basis of the output of the sensor. The sensor is located at a sensing position which lies in a replenishing range extending in the longitudinal direction of the replenishing member. The amount of toner replenished at a toner replenishing position facing the sensing position is selected to be smaller than the average amount of toner replenished in the replenishing range.

Moreover, in accordance with the present invention, an image forming apparatus comprises a developing unit for developing a latent image formed on an image carrier by a developer consisting of toner and a carrier, a toner concentration sensor for sensing the toner concentration of the developer stored in the developing unit, a replenishing member for replenishing the developing unit with toner, an agitating member for agitating and mixing with the developer the toner replenished to the developing unit, a reference image forming device for forming a reference toner image corresponding to a reference density pattern on the image carrier at a predetermined timing, an image density sensor for sensing the density of the reference toner image, and a concentration controller for controlling the replenishing member on the basis of the result of comparison of the output of the toner concentration sensor and a reference value, and correcting the reference value on the basis of the output of the image density sensor. The toner concentration sensor senses the toner concentration and the reference image forming device forms the reference density pattern, each at the time when the toner is not replenished.

In addition, in accordance with the present invention, an image forming apparatus comprises a developing unit for developing a latent image formed on an image carrier by a developer consisting of toner and a carrier, a toner of concentration sensor for sensing the toner concentration of the developer stored in the developing unit, a replenishing member for replenishing the developing unit with toner, an agitating member for agitating and mixing with the developer the toner replenished to the developing unit, a reference image forming device for forming a reference toner image corresponding to a reference density pattern on the image carrier at a predetermined timing, an image density sensor for sensing the density of the reference toner image, and a concentration controller for controlling the replenishing member on the basis of the result of comparison of the output of the toner concentration sensor appeared at a time of first toner concentration sensing and a reference value, and correcting the reference value on the basis of the output of the toner concentration sensor appeared at a time of second toner concentration sensing. The first toner sensing occurs when an operation for forming a toner image on the image carrier during image forming process substantially ends. The reference image forming device develops the reference density pattern after a toner replenishment has ended. The second toner concentration sensing occurs substantially at the same time as the development of the reference density pattern.

BRIEF DESCRIPTION OF THE DRAWINGS

The above and other objects, features and advantages of the present invention will become more apparent from the following detailed description taken with the accompanying drawings in which:

FIG. 7 is a timing chart indicative of a timing for developing a reference density pattern and representative of an alternative embodiment of the present invention; and FIG. 8 is a timing chart indicative of the development of a reference pattern and the second toner concentration sensing of the toner concentration sensor and representative of another alternative embodiment of the present invention.

DESCRIPTION OF THE PREFERRED EMBODIMENTS

Figure 1A:
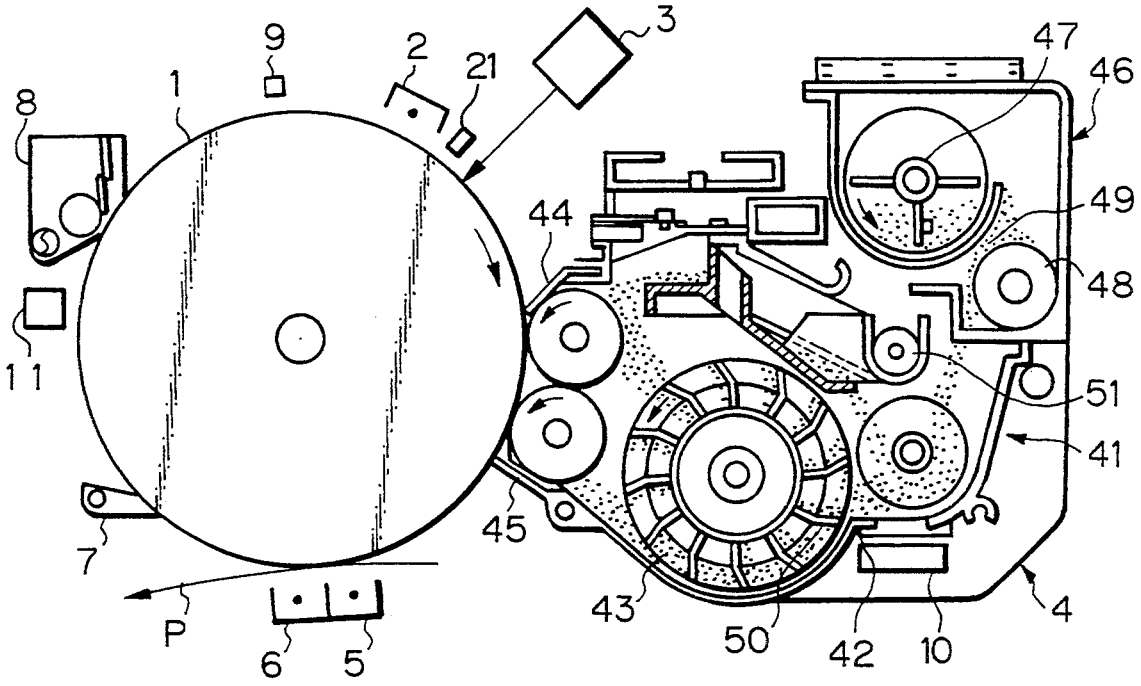
FIG. 1A is a section of an image forming apparatus embodying the present invention.

Referring to FIG. 1A of the drawings, an image forming apparatus embodying the present invention is shown and implemented as an electrophotographic copier by way of example. As shown, the copier has a photoconductive drum, or image carrier, 1 having a photoconductor on the surface thereof. While the drum 1 is rotated in a direction indicated by an arrow in the figure, a main charger 2 uniformly charges the surface of the drum 1. The charged surface of the drum 1 is illuminated imagewise by optics 3 with the result that a latent image is electrostatically formed on the drum 1. The latent image is developed by a developing unit 4 to turn out a toner image. The toner image is transferred to a sheet of paper or similar recording medium P by a transfer charger 5. The paper P carrying the toner image thereon is separated from the drum 1 by a separator 7. After the toner image of the paper P has been fixed by a fixing unit, not shown, the paper P is driven out of the copier. Toner particles remaining on the drum 1 after the image transfer are removed by a cleaning unit 8, and then charges also remaining on the drum 1 are dissipated by a discharger 9. As a result, the drum 1 is prepared for the next copying cycle.

The developing unit 4 has a casing 41 and a toner hopper, or toner container, 46 contiguous with the casing 41. An oval plate 42, a paddle wheel 43, an upper developing roller 44, a lower developing roller 45 and so forth are disposed in the casing 41. The oval plate 42 and paddle wheel 43 are rotatable members constituting developer agitating means. In the illustrative embodiment, the oval plate 42 has a diameter of 25 mm and rotates at a speed of 256 rpm (0.24 seconds per rotation), while the paddle wheel 43 has a diameter of 50 mm and rotates at a speed of 315 rpm (0.19 seconds per rotation). A developer is stored in the casing 41 and made up of toner and a carrier. The developer is scooped up by the the plate 42 and paddle wheel 43 while being agitated thereby. The upper and lower developing rollers 44 and 45 feed the toner to the drum 1. As the toner develops a latent image electrostatically formed on the drum 1, it is consumed.

Figure 1B:
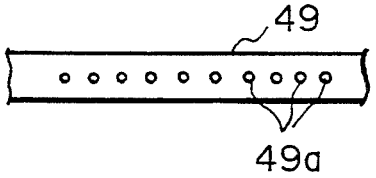
FIG. 1B shows a slitter included in the embodiment.
Figure 2:
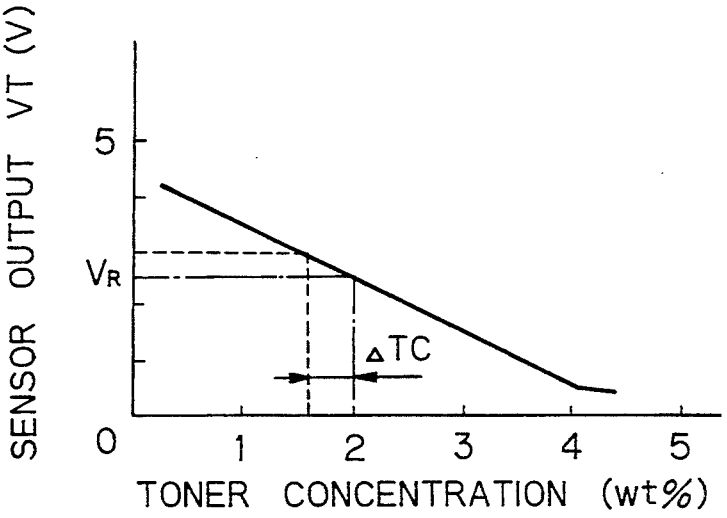
FIG. 2 is a graph representative of a relation between the toner concentration of a developer and the output of a toner concentration sensor.

The toner is sequentially consumed by the repetitive developing process. Hence, it is necessary to replenish the developer in the casing 41 with fresh toner in an amount corresponding to the consumed toner, so that the toner concentration of the developer may remain in a predetermined range. To meet this requirement, the embodiment has a toner concentration sensor 10 affixed to the inner periphery of the casing 41 below the oval plate 42 which is relatively close to a toner replenishing position. The sensor 10 is implemented by, for example, a permeability sensor. In addition, an agitator 47, a toner replenish roller or toner replenishing means 48, and a slitter or aperture member 49 are positioned in the toner hopper 46. The toner replenish roller 48 is provided with a saw-toothed surface. As .shown in FIG. 1B, the slitter 49 is formed with apertures **49*a* in the axial direction of the developing rollers 44 and 45; the apertures 49*a* are so sized as to allow toner particles to pass therethrough. FIG. 2 shows a relation between the output VT of the toner concentration sensor 10 and the toner concentration TC of the developer stored in the casing 41. This relation indicates that a decrement ΔTC (wt %) of the toner concentration can be determined on the basis of a difference between the sensor output VT and a reference value VR selected for control beforehand. From the decrement ΔTC and the weight m of the developer known beforehand, the amount of toner to be supplied ΔTC.m is derived. The duration of drive of the toner replenish roller 48, i.e., a toner replenishing time is determined by the amount of toner ΔTC.m and the ability of the roller 48**. In the embodiment, the reference value VR is so selected as to set up the toner concentration (2 wt %) of the initial reference developer.

Fresh toner in the toner hopper 46 is agitated and conveyed by the agitator 47. A clutch, not shown, is associated with the toner replenish roller 48 and coupled over the toner replenishing time at a predetermined timing. In this condition, as the slitter 49 rubs the surface of the saw-toothed surface of the roller 48, the toner is supplied to the casing 41 via the apertures 49*a* of the slitter 49. This part of the toner is mixed with the developer existing in the casing 41 by the oval plate 42.

Figure 3:
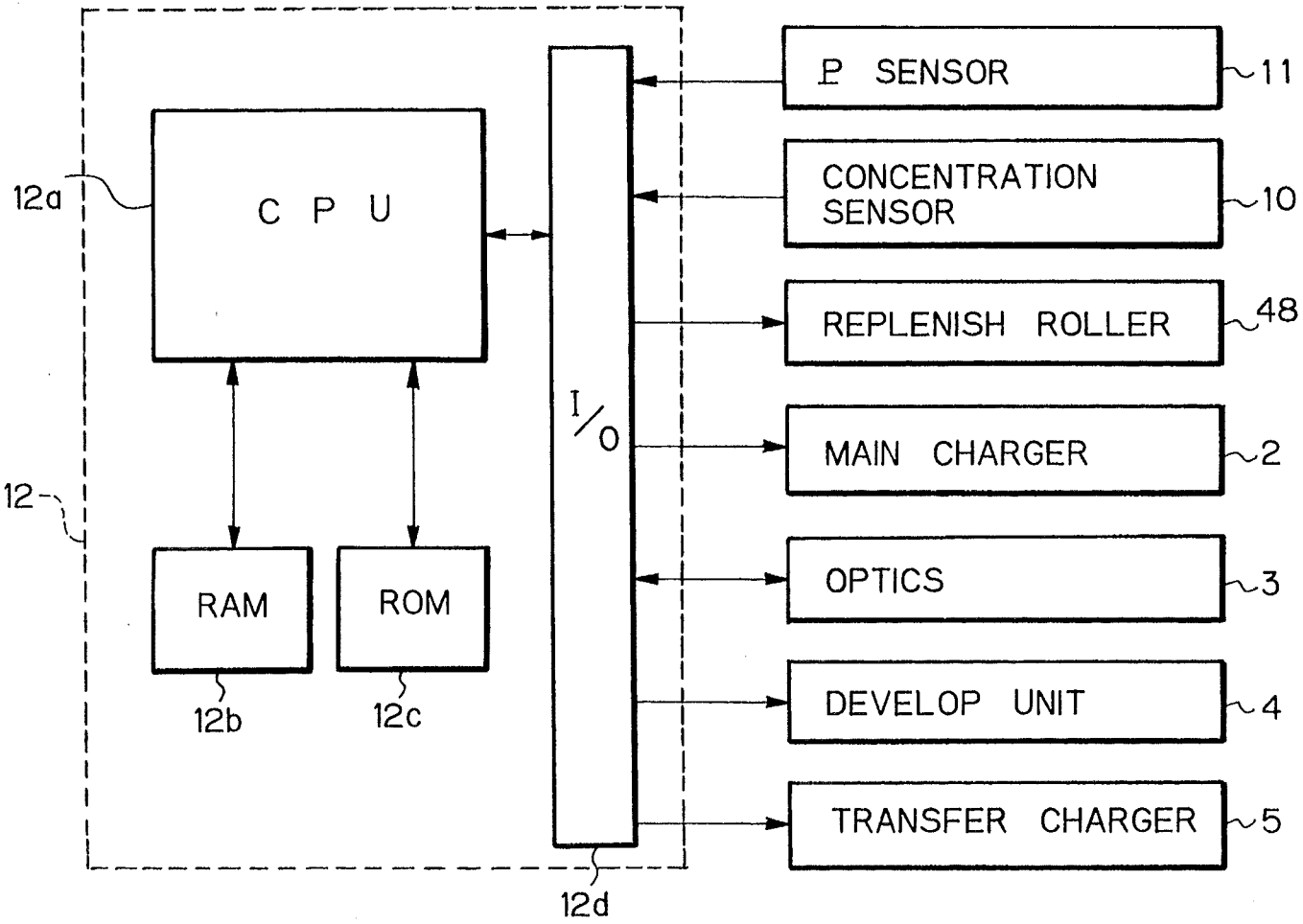
FIG. 3 is a block diagram schematically showing a toner concentration control system included in the embodiment.

FIG. 3 shows a control section, or toner concentration control means, 12. As shown, the control section 12 is basically made up of a main controller having a CPU (Central Processing Unit) 12*a*, a RAM (Random Access Memory) 12*b*, a ROM (Read Only Memory) 12*c*, and an I/O (Input/Output) section 12*d*. The control section 12 controls the main charger 2, optics 3, developing unit 4, transfer charger 5 and toner concentration sensor 10 as well as an optical image density sensor, or P sensor as sometimes referred to hereinafter, 11.

In the illustrative embodiment, the control section 12 uncouples the clutch of the toner replenish roller 48 to end toner replenishment, then drives the oval plate 42 for more than 0.24 second to cause it to rotate at least one full rotation, and then measures a toner concentration via the sensor 10. By the rotation of the oval plate 42, the replenished toner and existing toner are agitated and mixed at the sensing position of the sensor 10. As a result, the toner concentration at the sensing position becomes close to the average toner concentration of the entire developer existing in the casing 41. The resulting output of the sensor 10 is used to effect toner concentration control.

Figures 4A, 4B, 4C, 4D:
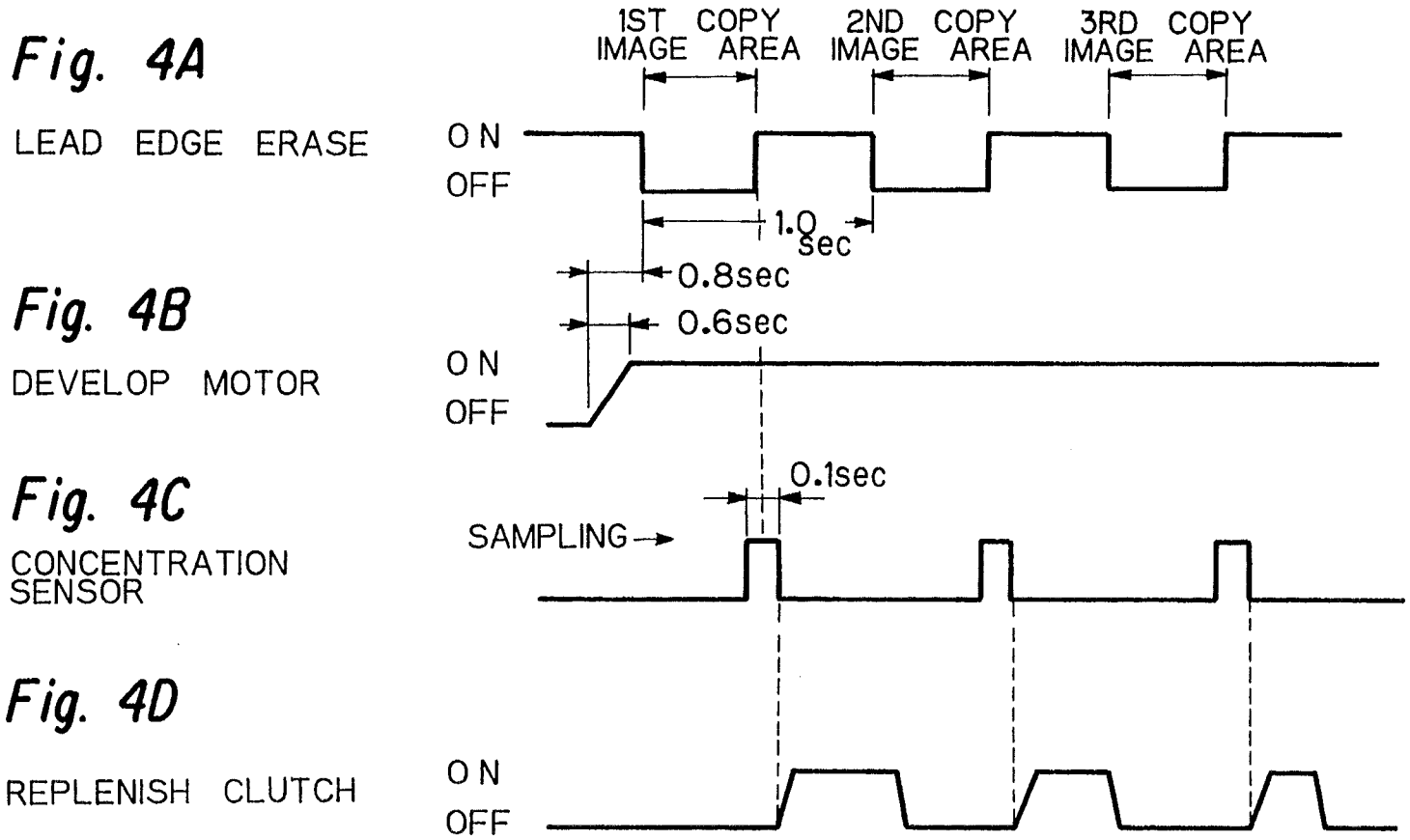
FIG. 4 is a timing chart demonstrating a specific toner concentration control procedure particular to the embodiment.

Assume that the replenishment by the toner replenish roller 48 should be effected when the developing position of the casing 41 faces a non-image area on the drum 1 as far as possible. Then, as shown in FIG. 4, the control section 12 may measure a toner concentration via the sensor 10 (sampling time of 0.1 second) after an image area on the drum 1 has been substantially fully developed for a single copy. Such a procedure allows the toner concentration lowered by the development of the image area to be sensed by the sensor 10 and used for toner concentration control. Therefore, the toner concentration control can be executed by sufficiently taking account of the influence of toner consumption. It is to be noted that FIG. 4 shows a specific case wherein the copying speed is 60 copies per minute (cpm), and the copying time for a single sheet of A4 size paper (placed horizontally long) is 1.0 second.

Figure 5A:
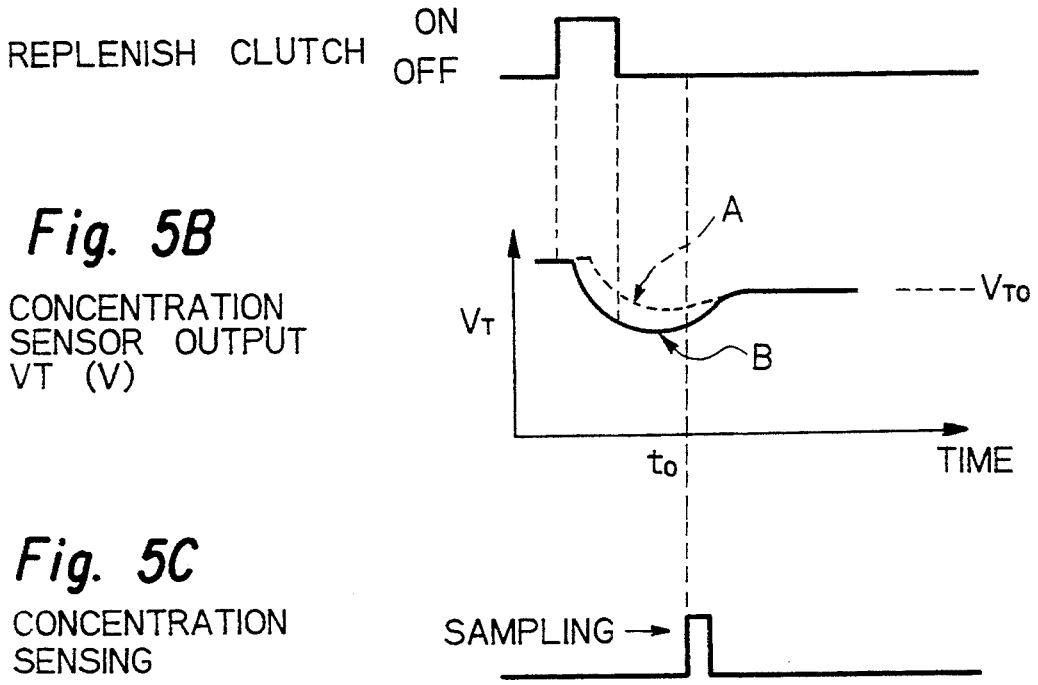
FIG. 5 shows how the output of the toner concentration sensor changes after toner replenishment.

The toner is replenished to the casing 41 via the apertures 49*a* of the slitter 49, as stated earlier. This, however, has a problem that just after the replenishment, the toner concentration becomes higher at positions facing the apertures 49*a* than at positions not facing them, resulting in an irregular distribution in the axial direction of the developing rollers 44 and 45. To eliminate this problem, the embodiment is constructed such that the amount of fresh toner as measured at the sensing position of the sensor 10 is smaller than the average amount of fresh toner in the entire toner replenishing range. For this purpose, the apertures 49*a* of the slitter 49 may be so positioned as not to face the sensor 10, or the diameter of those apertures 49*a* which face the center of the sensor 10 may be reduced to lower the replenishing ability. In this configuration, as a curve A of FIG. 5 indicates, the output VT of the sensor 10 reaches a stable level ($VT_0$) representative of the true toner concentration of the entire developer in the casing 41 rapidly. When the output VT is substantially brought to the stable level $VT_0$, a toner concentration is sensed. In FIG. 5, a curve B is indicative of the output VT of the sensor 10 appearing when the amount of fresh toner at the sensing position of the sensor 10 is greater than the average amount of fresh toner in the entire replenishing range.

As shown in FIG. 1, the apparatus further includes a separator 50 provided with oblique fins, not shown, and a screw 51. The separator 50 and screw 51 positively agitate the developer in the casing 41 in the axial direction of the developing rollers 44 and 45. This obviates an irregular toner concentration distribution in the above-mentioned direction which would influence image quality.

As stated above, the embodiment is capable of sensing the toner concentration of the entire casing 41 accurately despite that a single toner concentration sensor 10 is located relatively close to the toner replenishing position. Hence, the toner concentration can be controlled in harmony with the balance of toner in the entire casing 41.

An alternative embodiment of the present invention will be described hereinafter. Basically, this embodiment is also practicable with the arrangement shown in FIGS. 1A and 1B and is identical with the previous embodiment in respect of functions. While the previous embodiment implements toner concentration control by use of a fixed reference value VR, the alternative embodiment changes it. Specifically, in this embodiment, a reference toner image representative of a reference pattern having a predetermined density is formed on the drum 1 at a predetermined timing, e.g., when ten copies have been produced. The density of the reference toner image (amount of toner deposition) is sensed by the image density sensor or P sensor 11, FIG. 1A, located downstream of the transfer charger 5 and separation charger 6 in the direction of rotation of the drum 1. The reference value VR is changed on the basis of the resulting output Vsp of the P sensor 11. This enhances accurate correction of the reference value VR and, therefore, maintains the developing ability constant.

To form the reference toner image on the drum 1, there may be used a procedure in which the main charger 2 charges the drum 1 to a predetermined potential, the eraser 21 trims the charge to form a pattern having a predetermined size, and then the developing unit 4 develops the pattern. The P sensor 11 senses the image density of the reference toner image by measuring the intensity of light reflected from or transmitted through the image.

Figure 6:
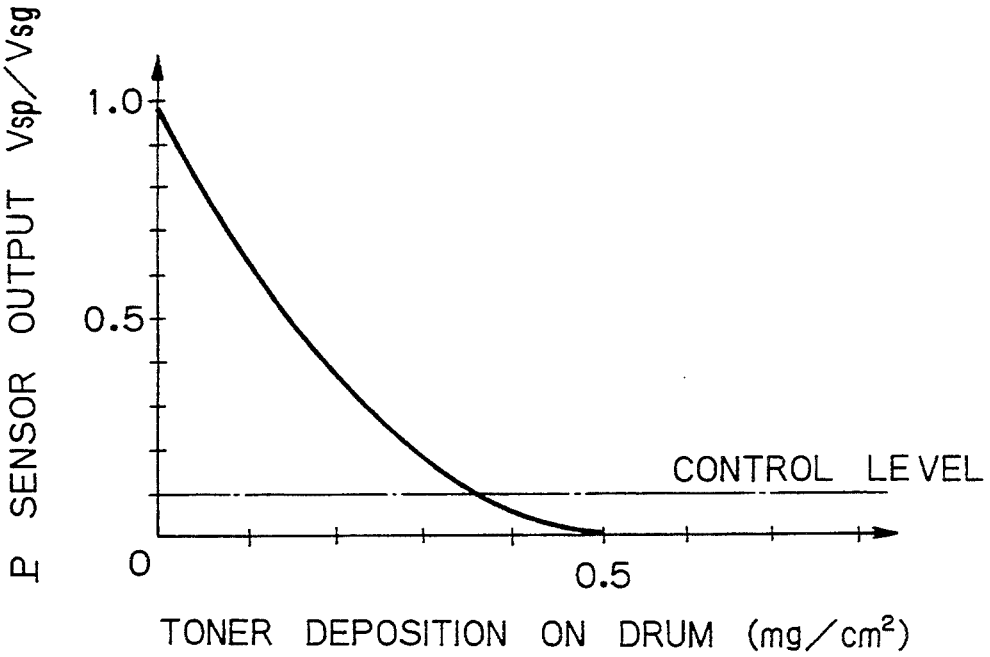
FIG. 6 is a graph indicative of a relation between the output of an optical image density sensor and the amount of toner deposition on a photoconductive element.

Preferably, the P sensor 11 should sense the background density of the drum 1 together with the density of the reference toner image. This allows the reference value VR to be corrected based on a ratio $\eta$ of the output Vsp of the P sensor representative of the density of the reference image to the output Vsg of the same representative of the background density ($\eta$=Vsp/Vsg). Specifically as shown in FIG. 6, the output Vsp/Vsg of the P sensor 11 changes depending on the amount of toner deposited on the reference toner image which is formed by a predetermined electric field. Therefore, the developing ability of the developer can be determined on the basis of the sensor output Vsp/Vsg. A control level corresponding to Vsp/Vsg=0.1 is set. When the sensor output Vsp/Vsg is greater than 0.1, meaning that the amount of toner deposition is small (image density is low), the reference value VR is shifted to a greater value to increase the toner concentration. When the sensor output Vsp/Vsg is smaller than 0.1, i.e., when the amount of toner deposition is great (image density is high), the reference value VR is shifted to a smaller value to reduce the toner concentration. For example, when the sensor output Vsp/Vsg changes from 0.1 to 0.2, the reference value VR is shifted down from 2.5 to 2.4, as shown in FIG. 2.

In the illustrative embodiment, the toner concentration sensor 10 senses a toner concentration and the reference density pattern is developed, each at the time when the fresh toner is not supplied. As shown in FIG. 7, the reference density pattern for correcting the reference value VR should preferably be developed after toner replenishment, i.e., after the previously stated clutch has been uncoupled.

As stated above, this embodiment causes the toner concentration sensor 10 to sense a toner concentration when fresh toner is not supplied. Consequently, the toner concentration of the developer substantially identical in property with the entire developer present in the casing 41 is sensed. The sensed concentration is used to effect toner concentration control. It follows that the toner concentration can be controlled stably in harmony with the balance of toner of the developer.

The reference density pattern is also developed when the fresh toner is not supplied. Hence, the reference pattern is developed by the developer substantially identical in property with the entire developer present in the casing 41. The P sensor 11 senses the amount of toner (image density) deposited on the reference pattern, and the output thereof is used to correct the reference value VR. This enhances accurate correction of the reference value VR, maintains a constant ability, and allows the toner concentration to be controlled stably in harmony with the balance of toner, thereby insuring stable image quality.

It is desirable that the interval between the replenishment of the toner and the development of the reference density pattern be as long as possible within an allowable range in respect of copying speed, preferably 0.2 second to 0.3 second.

Another alternative embodiment of the present invention will be described hereinafter. Basically, this embodiment is also practicable with the arrangement shown in FIGS. 1A and 1B and is identical with the previous embodiment in respect of functions. In this embodiment, to determine a toner replenishing time, a toner concentration is sensed for the first time (first sensing) when an operation for forming a toner image on the drum 1 during a copying cycle substantially ends. As a result, a toner concentration lowered by the image formation is sensed and used to control toner concentration. Since toner concentration control is executed by taking account of the influence of toner consumption sufficiently, it remains stable and conforms to the balance of toner.

In the preceding alternative embodiment, the reference value VR is corrected based solely on the output Vsp/Vsg of the P sensor 11. However, the toner concentration of the developed reference pattern is not always close to the control value VR. To improve the accuracy of correction, this embodiment corrects the reference value VR on the basis of the output Vsp/Vsg of the P sensor 11 and the output VT′ of the toner concentration sensor 10 to appear when a toner concentration is sensed again (second sensing). Specifically, the reference density pattern for the P sensor 11 is developed after the replenishment of a fresh toner, i.e., substantially at the same time as the second toner concentration sensing, as shown in FIG. 8. In this condition, the reference pattern is developed by the developer substantially identical in property with the entire developer in the casing 41. The P sensor 11 senses the amount of toner deposited on the reference pattern (image density). At the same time, the toner concentration TC′ of the developer is substantially identical in property with the developer that developed the reference pattern is sensed. The resulting outputs Vsp/Vsg and VT′ corresponding to the amount of toner deposited on the reference pattern and the toner concentration TC′, respectively, are used to correct the reference value VR. This is successful in further enhancing accurate correction of the reference value VR, maintaining a constant developing ability, and effecting stable toner concentration, thereby insuring stable image quality.

While the embodiments described above each uses the oval plate 42 for agitation, it may, of course, be replaced with a screw member, coil spring, paddle or similar rotatable agitating member.

In the embodiments shown and described, the amount of fresh toner as measured at the sensing position of the toner concentration sensor 10 is maintained smaller than the average amount of fresh toner in the entire replenishing range. For this purpose, the apertures **49*a* of the slitter 49 are so located as not to face the center of the sensor 10, or those apertures 49*a* which face the center of the sensor 10 are provided with a smaller diameter. Alternatively, when the apparatus includes a brush roller or similar toner replenishing means capable of replenishing toner over the entire width, a brush member included in the brush roller may have the length thereof reduced at a position where it faces the center of the sensor 10. Another possible implementation is to locate a screening member at a position facing the center of the sensor 10**.

In summary, it will be seen that the present invention provides an image forming apparatus capable of controlling toner concentration stably in harmony with the balance of toner, despite that a single toner concentration sensing means is located relatively close to a toner replenishing position.

Further, the apparatus of the present invention enhances accurate correction of a reference value for toner concentration control, maintains constant developing ability, and effects stable toner concentration in harmony with the balance of toner, thereby insuring stable image quality, despite the use of a single toner concentration sensing means.

Various modifications will become possible for those skilled in the art after receiving the teachings of the present disclosure without departing from the scope thereof.

What is claimed is:

1. An image forming apparatus, comprising:

a developing unit for developing a latent image formed on an image carrier by a developer including toner and a carrier;

sensing means for sensing a toner concentration of the developer stored in said developing unit;

replenishing means for replenishing said developing unit with toner from a toner container through a plurality of apertures;

agitating means having a rotatable member for agitating and mixing with the developer the toner replenished to said developing unit;

concentration control means for controlling said replenishing means on the basis of an output of said sensing means; and control means for controlling said sensing means such that said sensing means senses the toner concentration of the developer present in said developing unit after a replenishing operation of said replenishing means has ended and after said rotatable member has completed one rotation.

2. An apparatus as claimed in claim 1, wherein said sensing means is located at a sensing position facing said rotatable member.

3. An apparatus as claimed in claim 2, wherein said replenishing means replenishes the toner through the plurality of apertures which are formed in a member intervening between said toner container and said developing unit.

4. An apparatus as claimed in claim 3, wherein said apertures of said member are configured such that an amount of toner replenished at a toner replenishing position facing said sensing position of said sensing means is smaller than an average amount of toner replenished in an entire replenishing region.

5. An image forming apparatus, comprising:

a developing unit for developing a latent image formed on an image carrier by a developer including toner and a carrier;

sensing means for sensing a toner concentration of the developer stored in said developing unit;

replenishing means for replenishing said developing unit with toner from a toner container through a plurality of apertures;

agitating means for agitating and mixing with the developer the toner replenished to said developing unit;

concentration control means for controlling said replenishing means on the basis of an output of said sensing means; and control means for controlling said sensing means such that said sensing means senses the toner concentration of the developer present in said developing unit when an operation for developing the latent image on the image carrier substantially ends.

6. An apparatus as claimed in claim 5, wherein said replenishing means replenishes the toner through the plurality of apertures which are formed in a member intervening between said toner container and said developing unit.

7. An apparatus as claimed in claim 6, wherein said apertures of said member are configured such that an amount of toner replenished at a toner replenishing position facing said sensing means is smaller than an average amount of toner replenished in an entire replenishing region.

8. An image forming apparatus, comprising:

a developing unit for developing a latent image formed on an image carrier by a developer including toner and a carrier;

sensing means for sensing a toner concentration of the developer stored in said developing unit;

replenishing means for replenishing said developing unit with toner;

agitating means for agitating and mixing with the developer the toner replenished to said developing unit; and concentration control means for controlling said replenishing means on the basis of an output of said sensing means;

wherein said sensing means is located at a sensing position which lies in a replenishing region extending in a longitudinal direction of said replenishing means; and wherein an amount of toner replenished at a toner replenishing position facing said sensing position is smaller than an average amount of toner replenished in said replenishing region.

9. An apparatus as claimed in claim 8, wherein the toner is replenished from a toner container to said developing unit.

10. An apparatus as claimed in claim 9, wherein said replenishing means replenishes the toner through a plurality of apertures formed in a member intervening between said toner container and said developing unit.

11. An apparatus as claimed in claim 10, wherein said apertures of said member are configured such that the amount of toner replenished at the toner replenishing position facing said sensing position of said sensing means is smaller than the average amount of toner replenished in an entire replenishing region.

12. An image forming apparatus, comprising:

a developing unit for developing a latent image formed on an image carrier by a developer including toner and a carrier;

toner concentration sensing means for sensing a toner concentration of the developer stored in said developing unit;

replenishing means for replenishing said developing unit with toner;

agitating means for agitating and mixing with the developer the toner replenished to said developing unit;

reference image forming means for forming a reference toner image corresponding to a reference density pattern on the image carrier at a predetermined time;

image density sensing means for sensing a density of said reference toner image; and concentration control means for controlling said replenishing means on the basis of a result of comparison of an output of said toner concentration sensing means and a reference value, and correcting said reference value on the basis of an output of said image density sensing means;

wherein both said toner concentration sensing means senses the toner concentration and said reference image forming means forms the reference density pattern at a time when the toner is not replenished.

13. An image forming apparatus, comprising:

a developing unit for developing a latent image formed on an image carrier by a developer including toner and a carrier;

toner concentration sensing means for sensing a toner concentration of the developer stored in said developing unit;

replenishing means for replenishing said developing unit with toner;

agitating means for agitating and mixing with the developer the toner replenished to said developing unit;

reference image forming means for forming a reference toner image corresponding to a reference density pattern on the image carrier at a predetermined time;

image density sensing means for sensing a density of said reference toner image; and concentration control means for controlling said replenishing means on the basis of a result of comparison of an output of said toner concentration sensing means at a time of first toner concentration sensing with a reference value, and correcting said reference value on the basis of an output of said toner concentration sensing means at a time of second toner concentration sensing;

wherein said first toner concentration sensing occurs when an operation for forming a toner image on the image carrier during an image forming process substantially ends, said reference image forming means develops said reference density pattern after a toner replenishment has ended, and said second toner concentration sensing occurs at substantially the same time as development of said reference density pattern.

14. An image forming apparatus, comprising:

a developing unit for developing a latent image formed on an image carrier by a developer including toner and a carrier;

sensing means for sensing a toner concentration of the developer stored in said developing unit;

replenishing means for replenishing said developing unit with toner from a toner container through a plurality of apertures;

agitating means for agitating and mixing with the developer the toner replenished to said developing unit; and concentration control means for controlling said replenishing means on the basis of an output of said sensing means.

15. An apparatus as claimed in claim 14, wherein said replenishing means replenishes the toner through the plurality of apertures which are formed in a member intervening between said toner container and said developing unit.

16. An apparatus as claimed in claim 15, wherein said apertures of said member are configured such that an amount of toner replenished at a toner replenishing position facing said sensing means is smaller than an average amount of toner replenished in an entire replenishing region.

* * * * *